US007772943B2

(12) United States Patent
DeBoer et al.

(10) Patent No.: US 7,772,943 B2
(45) Date of Patent: Aug. 10, 2010

(54) DESIGN AND METHOD FOR KEEPING ELECTRICAL CONTACTS CLOSED DURING SHORT CIRCUITS

(75) Inventors: John DeBoer, Decatur, GA (US); Brian Timothy McCoy, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 204 days.

(21) Appl. No.: 11/823,751

(22) Filed: Jun. 27, 2007

(65) Prior Publication Data

US 2008/0012665 A1 Jan. 17, 2008

Related U.S. Application Data

(60) Provisional application No. 60/830,533, filed on Jul. 13, 2006.

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 53/00*** | (2006.01) |
| ***H01H 3/00*** | (2006.01) |
| ***H01H 9/44*** | (2006.01) |
| ***H01H 33/18*** | (2006.01) |

(52) U.S. Cl. ..... 335/16; 335/147; 335/195; 218/22

(58) Field of Classification Search ..... 335/16, 335/147, 195; 218/22
See application file for complete search history.

(56) References Cited

U.S. PATENT DOCUMENTS

| | | | | |
|---|---|---|---|---|
| 4,849,590 | A * | 7/1989 | Becker et al. | 218/33 |
| 5,072,082 | A * | 12/1991 | Kowalik | 218/23 |
| 5,301,083 | A * | 4/1994 | Grass et al. | 361/64 |
| 5,694,098 | A * | 12/1997 | Mody et al. | 335/16 |
| 6,034,581 | A * | 3/2000 | DiMarco et al. | 335/16 |
| 6,714,108 | B1 | 3/2004 | Erb et al. | |
| 6,724,284 | B2 * | 4/2004 | Simms et al. | 335/14 |
| 6,812,815 | B2 * | 11/2004 | Simms et al. | 335/6 |
| 2004/0196123 | A1 | 10/2004 | Erb et al. | |

* cited by examiner

*Primary Examiner*—Lincoln Donovan
*Assistant Examiner*—Alexander Talpalatskiy
(74) *Attorney, Agent, or Firm*—Jose de la Rosa

(57) ABSTRACT

An electrical contact assembly resists blow-open under conditions of increased current flow. The contact assembly includes parallel conducting surfaces on fixed and moveable conductors that generate forces biasing the contacts together under current flow conditions. The assembly also includes a magnetic armature and yoke that exert a magnetic force to resist movement of the contacts toward the open position. Current flowing through both the fixed and moveable conductors contribute to the magnetic force. A spring may additionally bias the contacts to the closed position. The contact assembly may be used in remote-controlled circuit breaker applications.

20 Claims, 6 Drawing Sheets

DESIGN AND METHOD FOR KEEPING ELECTRICAL CONTACTS CLOSED DURING SHORT CIRCUITS

CROSS REFERENCE TO RELATED APPLICATIONS

This application claims the benefit of priority from U.S. Provisional Patent Application Ser. No. 60/830,533 entitled "Design and Method for Keeping Electrical Contacts Closed During Short Circuits," filed on Jul. 13, 2006, the contents of which are hereby incorporated by reference herein in their entirety.

FIELD OF THE INVENTION

The present invention relates generally to an improved contact assembly and circuit breaker assembly, and more particularly, to a remote controlled circuit breaker assembly having remote controlled contacts that resist blowing open under increased load conditions.

BACKGROUND OF THE INVENTION

There has been an increasing demand for remotely controllable circuit breaker assemblies that can reciprocate between an open circuit and a closed circuit in response to a remotely generated command. One advantageous application for such circuit breaker assemblies is in control panelboards that are used for automated control systems such as automated lighting systems. Automated lighting systems have been developed for the control of lighting circuits based upon inputs such as the time-of-day, wall switches, occupancy sensors and/or control from a power distribution system. Lighting control systems offer an opportunity to save energy by automating the process of cutting back on the number of lighting fixtures that are illuminated, or by cutting out artificial lighting altogether when circumstances warrant. For example, ambient light sensors can be used to control lighting circuits in response to ambient light levels. The sensors can serve both switching and automatic dimming functions that can adjust the output of the lighting system continually in response to the amount of daylight striking the ambient light sensor. Occupancy sensors can be used to activate lighting when someone is in a space and to deactivate the lighting, perhaps after a set time interval, when a person is no longer detected in the space.

In general, circuit breaker assemblies that can be remotely controlled may be divided into at least two classes. The first is the remote-operated circuit breaker. In a remote-operated circuit breaker, two pairs of contacts are located within a single package. The first (or primary) pair of contacts is used to interrupt short circuits, to interrupt overloads, and to switch the circuit breaker on and off via a handle. The second pair of contacts in a remote operated circuit breaker may be used, for example, in a lighting control application. Those secondary contacts are intended to be switched more often than the primary pair of contacts, but do not have the robustness to maintain their intended function if exposed to the arc and heat associated with a short circuit. It is therefore important that the secondary pair of contacts be maintained in a closed position when "large" currents (for this purpose 1,000-20,000 amperes) are passed through the remote operated circuit breaker. Without the incorporation of specific design features, electromagnetic forces tend to open those secondary contacts under large current loads before the primary contacts interrupt the circuit, causing arcing and heating and potentially damaging the contacts.

Another class of remotely controlled circuit breaker assemblies is an assembly that includes a circuit control pod. In such an assembly, a relay device or "pod" (with means to operate a pair of contacts remotely) is attached to a standard circuit breaker that does not have a means of remote operation. The circuit control pod adds an additional pair of contacts in series with the circuit breaker. Like the secondary contacts of the remote-operated circuit breaker described above, the secondary contacts of the circuit control pod must be held closed during short circuit and overload conditions. If the secondary contacts are not held closed, the interruption of a short circuit may be split between the circuit breaker and the circuit control pod. Under those conditions, there is a high risk that the circuit control pod would be damaged.

Several designs have been proposed for preventing contacts from blowing open under increased current loads. For example, it is known to use a spring to maintain electrical contacts in a closed position.

U.S. Pat. No. 5,301,083 discloses a contact pair having a moveable contact arm with a hold-down electromagnet that exerts increasing force with increasing current through the contact arm.

U.S. Pat. No. 6,034,581 discloses a contact assembly in which parallel current flow in the moveable contact arm and adjacent conductors creates attractive and repulsive forces that hold the contacts together to resist unintended separation.

There is presently a need for an improved design and method for keeping a pair of contacts closed during a short circuit. Such a design should have a low cost and should be of high reliability. Such a design should furthermore be compact for use in a small package area. Accordingly, it is an object of this invention to provide a reliable, low cost and compact remotely controllable circuit breaker assembly. To the inventors' knowledge, no such remotely controllable circuit breaker assembly is currently available.

SUMMARY OF THE INVENTION

One embodiment of the present invention is a contact assembly having a closed position to allow current flow through the contact assembly and an open position to prevent current flow through the contact assembly. The assembly comprises a moveable conductor including a moveable contact and a moveable conducting surface. The assembly also includes a fixed contact. The moveable conductor is moveable between the closed position with the moveable contact contacting the fixed contact, and the open position with the moveable contact spaced apart from the fixed contact. The assembly further includes a fixed conductor having a fixed conducting surface proximate the moveable conducting surface when the contact assembly is in the closed position, the moveable and fixed conductors being electrically connected to conduct the current flow through the conductors in directions such that electromagnetic forces generated thereby resist movement of the moveable contact toward the open position. A magnetic armature is fixed to the moveable conductor, and a magnetic yoke is in proximate the fixed conductor, whereby current through the fixed conductor causes the yoke to exert a magnetic force on the armature, and thereby resist movement of the moveable contact toward the open position.

The contact assembly may further include a spring biasing the moveable contact toward the fixed contact, to resist movement of the moveable contact toward the open position.

The assembly may include a braided wire electrically connecting the moveable and fixed conductors. The braided wire connection may be the only braided wire connection of the contact assembly. The fixed conductor may include a tab extending from the fixed conductor in a direction away from a plane of the fixed conductor, the braided wire being connected to the tab, whereby parasitic loss in the magnetic field of the moveable and fixed conducting surfaces due to a secondary magnetic field is reduced.

The fixed conductor may include a U-shaped portion defining a slot, the yoke being positioned in the slot. The fixed conducting surface may include at least a portion of the U-shaped portion.

The electromagnetic armature may be fixed to the moveable conductor by a connection selected from the group consisting of a brazed connection and a welded connection.

The magnetic yoke may further be in proximity to the moveable conductor, whereby current through the moveable conductor supplements the current through the fixed conductor in causing the yoke to exert a magnetic force on the armature, and thereby resist movement of the moveable contact toward the open position Another embodiment of the invention is a method for maintaining a contact assembly in a closed position to allow a current flow through the contact assembly, and preventing the contact assembly from moving to an open position in which current flow is not allowed through the contact assembly. A moveable conductor having a moveable contact and a moveable conducting surface is displaced from the open position with the moveable contact spaced apart from a fixed contact, to the closed position with the moveable contact contacting the fixed contact. Current is flowed through the moveable conductor and through the fixed and moveable contacts; and current is flowed through a fixed conductor having a fixed conducting surface proximate the moveable conducting surface when the contact assembly is in the closed position.

Electromagnetic forces between the fixed and moveable conductors are generated by the flowing current through the fixed and moveable conductors. The electromagnetic forces resisting movement of the moveable contact toward the open position. A magnetic field is created by the flowing current through the fixed conductor and the moveable conductor in a magnetic yoke in proximity to the fixed conductor, the magnetic field causing the yoke to exert a magnetic force on a magnetic armature fixed to the moveable conductor, thereby further resisting movement of the moveable contact toward the open position.

The method may further include the step of biasing the moveable and fixed contacts toward each other with a spring, to thereby resist movement of the moveable contact toward the open position.

The method may also comprise the step of flowing the electric current through a braided wire electrically connecting the moveable and fixed conductors. The braided wire connection may be the only braided wire connection of the contact assembly. The current may additionally be flowed through a tab extending from the fixed conductor away from a plane of the fixed conductor, the braided wire being connected to the tab, whereby parasitic loss in the magnetic field of the moveable and fixed conducting surfaces due to a secondary magnetic field is reduced.

The step of flowing the current through the fixed conductor may comprise flowing the current around at least two opposite sides the yoke.

The steps of generating electromagnetic forces and creating a magnetic field may be performed simultaneously by current flowing through a single portion of the fixed conductor. The electromagnetic armature may be fixed to the moveable conductor by a connection selected from the group consisting of a brazed connection and a welded connection.

Another embodiment of the invention is a circuit breaker assembly positionable in a circuit between a line and a load. The assembly includes a circuit breaker set to open the circuit between the line and the load at or above a predetermined current load, and a circuit control pod in series with the circuit breaker and adapted to remotely open and close the circuit between the line and the load, the circuit control pod comprising a contact assembly having a closed position to allow current flow through the contact assembly and an open position to prevent current flow through the contact assembly.

The contact assembly comprises a moveable conductor having a moveable contact and a moveable conducting surface. The assembly also includes a fixed contact. The moveable conductor is moveable between the closed position with the moveable contact contacting the fixed contact, and the open position with the moveable contact spaced apart from the fixed contact.

The contact assembly further comprises a fixed conductor defining a U-shaped conducting path having a fixed conducting surface proximate the moveable conducting surface when the contact assembly is in the closed position, the U-shaped conducting path defining a slot; the moveable and fixed conductors being electrically connected to conduct the current flow through the conductors in directions such that electromagnetic forces generated thereby resist movement of the moveable contact toward the open position. The contact assembly also includes a magnetic armature fixed to the moveable conductor; and a magnetic yoke disposed in the slot defined by the U-shaped conducting path of the fixed conductor, whereby current through the fixed and moveable conductors causes the yoke to exert a magnetic force on the armature, and thereby resist movement of the moveable contact toward the open position.

Yet another embodiment of the invention is a contact assembly having a closed position to allow current flow through the contact assembly and an open position to prevent current flow through the contact assembly. The assembly includes a moveable conductor including a moveable contact, and further includes a fixed contact. The moveable conductor is moveable between the closed position with the moveable contact contacting the fixed contact, and the open position with the moveable contact spaced apart from the fixed contact. A spring biases the moveable contact toward the fixed contact, to thereby resist movement of the moveable contact toward the open position.

The assembly further includes a fixed conductor. The moveable and fixed conductors are electrically connected in series to conduct the current through the conductors. A magnetic armature is fixed to the moveable conductor.

A magnetic yoke is proximate the fixed conductor and proximate the moving conductor. Current through each of the fixed conductor and the moveable conductor induces a magnetic field in the yoke to attract the armature, and thereby resists movement of the moveable contact toward the open position.

DESCRIPTION OF THE INVENTION

The present invention relates to a method and apparatus for keeping a pair of contacts closed as they conduct current in a wide range of levels. The invention incorporates features that act independently of the current level, proportionally to the current level, and proportionally to the square of the current level. Those three levels of control allow a designer greater flexibility when creating a system that protects a pair of contacts from opening unexpectedly. The contact assembly of the invention is particularly useful in remote controlled devices where one pair of contacts is not intended to interrupt a short-circuit event. Specific examples of such applications include circuit breakers, relays, contactors, and breaker accessories that are used for lighting control.

The present invention incorporates a "blow closed" loop that prevents the separation of contacts in the contact assembly during short circuits. The contact assembly of the present invention utilizes a grouping from the following elements to prevent the contacts from separating during abnormal current conditions:

1. A compression spring.
2. A magnetic yoke and armature functioning as an electromagnet.
3. A shaping of conductive elements such that two parallel paths of current are drawn across one another.

The spring prevents the contacts from blowing apart during lower amperages. In a typical case, the spring is effective in reducing blow-open from 1 ampere to approximately 600 amperes. In the present invention, the spring may be used to provide approximately 0.5 pounds force at the contact surface. That force is adequate to keep the contacts closed during normal operation and provided the force needed to keep the contacts in one of the two stable positions (i.e., open and closed). The inventors have found, however, that a spring exerting 0.5 pounds force is insufficient to keep the contacts closed during a short circuit, even in combination with a parallel conductor element.

Figure 1:
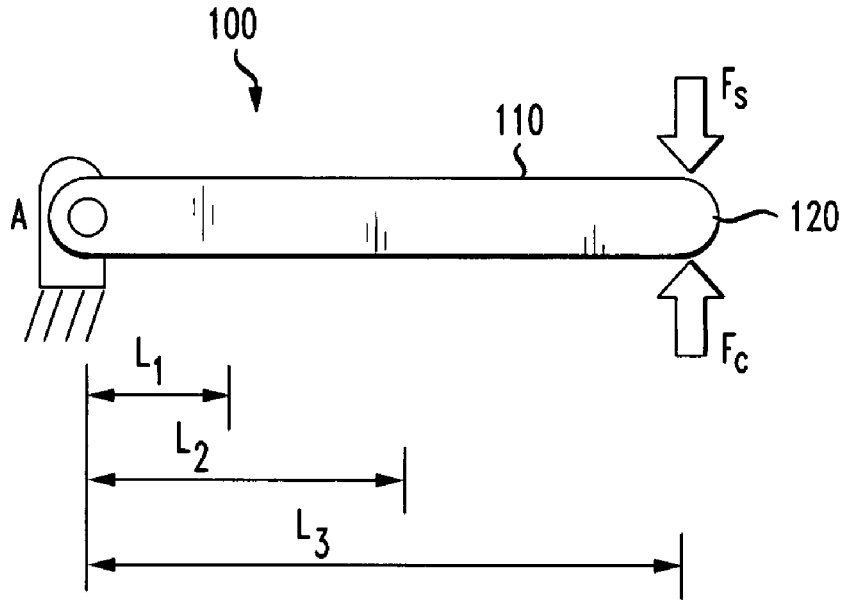
FIG. 1 is a simplified force diagram showing a moveable conducting member in accordance with the invention.

FIG. 1 is a simple force diagram 100 of a moveable conductor 110 of the invention. The conductor 110 is shown having a simplified pivot point A, although the conductor may, in practice, be cantilever-mounted for bending motion. The moveable conductor 110 carries a moveable contact of a contact pair (not shown) at a distal end 120 of the conductor 110.

In general, there is a contact separation force $F_c$ that is proportional to the square of the current that is attempting to rotate an arm of length L3 about the point A. The force $F_c$ is a result of repulsion forces at the contact points. A spring (not shown) may provide a force $F_s$ that counteracts the force $F_c$ in order to "blow" the contacts closed and maintain static equilibrium. It should be noted that if $F_s>F_c$, no motion will occur (although this is not illustrated by the free body diagram of FIG. 1). If, however, $F_s<F_c$, motion will occur and the contacts will "blow apart."

A magnetic yoke and armature combination may also be used to reduce "blow apart" of the contacts. By adding a yoke and armature to the mechanism associated with a pair of contacts, a magnetic circuit is created through the yoke and armature to keep the contacts closed during a short circuit.

Figure 2:
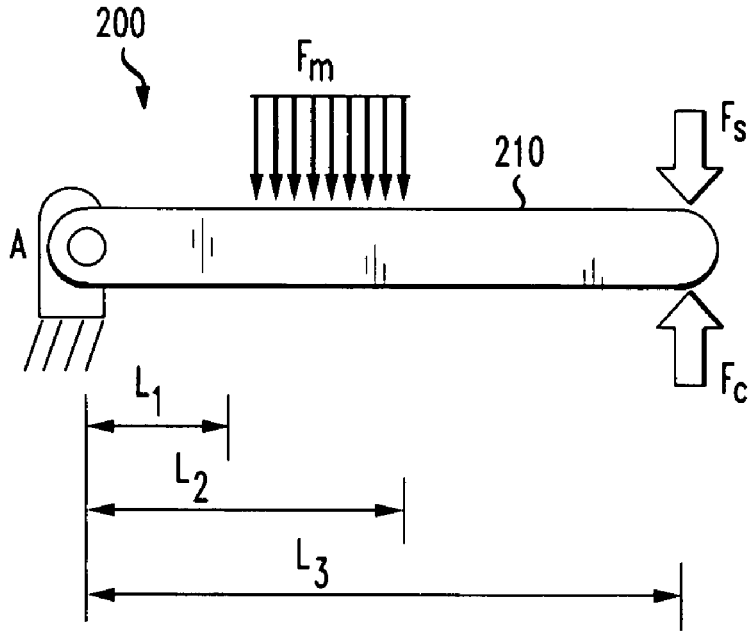
FIG. 2 is a simplified force diagram showing a moveable conducting member in accordance with the invention.

FIG. 2 is a force diagram 200 of a moveable conductor 210 acted on by a yoke and armature (not shown) in addition to a spring. In that case, a force $F_m$ now works with $F_s$ to counteract $F_c$ and maintain equilibrium.

A contact assembly relying on a spring and a magnet to counteract separation forces at the contacts has several limitations. First, the magnetic field associated with the yoke and armature requires substantial current to saturate, and there is a risk that blow-off (i.e., when $F_m$ is small and $F_c>F_s$) will occur before the magnet can saturate. Before saturation of the magnet, the current flowing through the contacts tends to separate the contacts, while the spring is essentially the only force urging the contacts closed, because the magnet will not yet be generating a large magnetic force. Before saturation of the magnet, the scenario therefore resembles the force diagram of FIG. 1 instead of that of FIG. 2. Because the magnet is not generating a large force, the current may blow the contacts apart.

The risk of contact blow-off may be further elevated by the use of a low-force spring ($F_s$ is very small). Low-force springs may be used in a contact assembly design to reduce overall package size, to decrease switching forces and to control wear on contacts and other components. With a small spring force $F_s$, less current is required to generate the scenario where $F_c>F_s$ and motion could begin. Therefore, in the case of moderate currents where a magnet/armature arrangement is not saturated, there is a need for a system that improves upon the case where only a spring and magnet are used.

Another limitation of a spring and magnet design appears at very high currents. The separation force generated at the contacts is proportional to the square of the current passing through the contacts. Electromagnets, however, reach a point of saturation beyond which their incremental force generation is proportional only to current. There is therefore always a current level at which the separation force $F_c$ will exceed the force $F_m$ of the magnet plus the force $F_s$ of the spring, and at which the contacts will blow open.

To overcome those limitations, the inventors have incorporated an additional element in the blow-closed contact assembly of the invention. Specifically, a parallel conductor arrangement has been added to improve the performance of the blow-closed function of the assembly.

As is known in the art, current traveling along adjacent conductors in the same direction tends to attract the conductors toward one another by the generation of electromagnetic forces. Current flowing in opposite directions through adjacent conductors tends to generate repulsive electromagnetic forces. As described in more detail below, such electromagnetic forces are applied in the present invention to the moveable conductor and, in cooperation with the spring force and the force of the electromagnet, resist the unintended opening of the contact assembly during fault conditions when the current flow could otherwise urge the contact assembly to open due to repulsion forces at the contact points.

The use of parallel conductors serves several functions. First, in those embodiments of the invention in which current flows in the same direction in the parallel paths, the added fixed conductor effectively adds a second turn to above-described electromagnet. The two parallel conductors each contribute to the magnetic field created in the yoke. The second turn therefore reduces the current required to saturate the magnet by about one-half. By cutting the saturation current level in half, the inventive design effectively achieves a higher closing force at a lower current level. That ensures that the contacts will remain closed over a wider current range during short circuits, including the lower current ranges discussed above as problematic with a spring-plus-magnet-only design.

Another function of the parallel conductors is to add a secondary, non-saturating force that maintains the contacts closed. As noted above, the contact separation force increases with the square of the current passing through the contacts. As further discussed above, the electromagnet has a threshold where the force per unit of current is maximized. Therefore there is a threshold where the magnet can no longer resist the blow-off force. The parallel current paths used in the present invention, however, exert forces on one another that are proportional to the square of the current and proportional to the length over which the parallel conductors are acting. That force, when combined with a properly sized spring and magnet, scales with the contact blow-off force and keeps the contacts closed.

Figure 3:
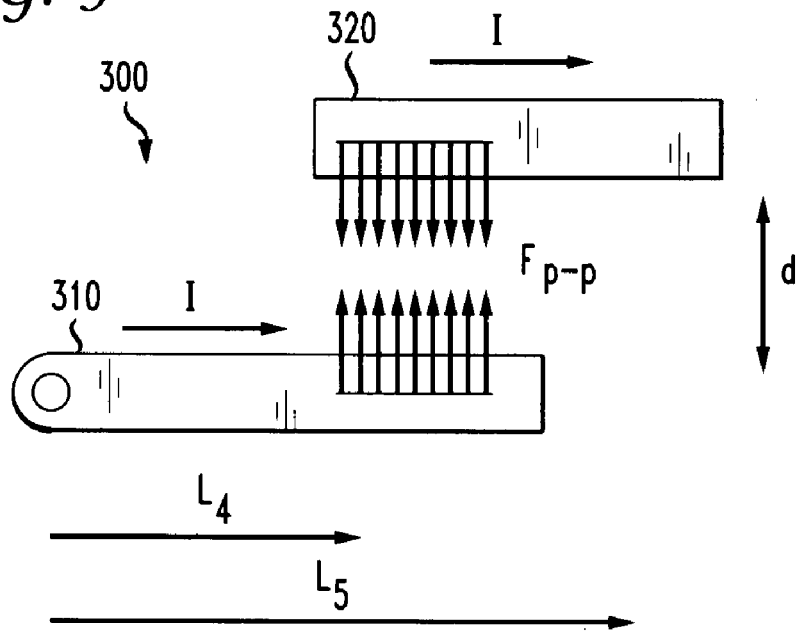
FIG. 3 is a simplified force diagram showing a moveable conducting member and a fixed conductor in accordance with the invention.

FIG. 3 is a schematic force diagram 300 showing a force $F_{p\text{-}p}$ from the parallel conductor arrangement acting on the moveable conductor 310. The region L5-L4 defines the area where the two parallel conductors overlap. The current I travels through both the moveable conductor 310 and a parallel fixed conductor 320. Opposing surfaces of the conductors 310, 320 define a gap d between the conductors. The current I travels in the same direction in both conductors, resulting in an attractive force $F_{p\text{-}p}$ between the conductors. In the case where the current travels in opposite directions in the conductors, a repulsive force results.

The force $F_{p\text{-}p}$, between the two current-carrying conductors may be described by the following relationship:

$$F_{p-p} = 4.5 * 10^{-8} * I^2 \frac{L5 - L4}{d} \cos\Theta$$

where Θ is an angle between the conductors.

Figure 4:
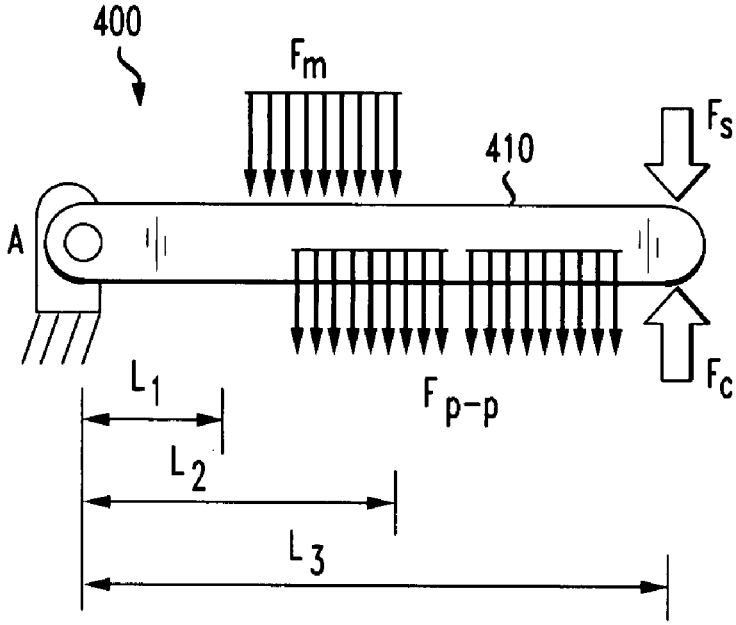
FIG. 4 is a simplified force diagram showing a moveable conducting member in accordance with the invention.

FIG. 4 shows a force diagram 400 of a moveable conductor 410. The electromagnetic force $F_m$, the parallel conductor force $F_{p\text{-}p}$, and the spring force $F_s$ are all acting to counteract the contact repulsion force $F_c$. As discussed above, the magnetic force $F_m$ reaches its maximum contribution with one-half the current that would otherwise be required. The force $F_{p\text{-}p}$ due to the parallel conductors provides an additional torque about the pivot A that keeps the system in equilibrium.

The present invention has significant advantages over a contact assembly having only a spring and parallel conductors to counteract the repulsive forces at the contacts. Parallel conductors are highly sensitive to the gap, the force $F_{p\text{-}p}$ being proportional to the reciprocal of the gap distance d between the parallel conductors. The force $F_{p\text{-}p}$ is also sensitive to the length of the parallel conductors. In situations where design constraints require a minimum gap to be maintained or where substantial length (L5-L4) is not available, the parallel conductors may fail to keep the contacts closed in the case of moderate levels of current.

The contact assembly of the present invention achieves its required function in a small package area and without the use of a large spring or large motion. The small package is desirable because space is always a consideration in the design of circuit breakers packages. The use of a lower force spring over a short distance is desired because it reduces the work required to turn the device on and off. That reduction in work, in turn, lowers friction, decreases wear, and reduces the size of the required remote operation actuator.

Based upon that concept, several specific variations of the physical layout are discussed below with reference to FIGS. 5A-5G. It is noted that those layouts are merely exemplary embodiments, and are not intended to limit the scope of the invention.

In each of the illustrated embodiments, the parallel conductor blow-closed region is also the position where the electromagnet is located. The components of the electromagnet are not shown in the schematic representations of FIGS. 5A-5G. In general, the armature is positioned on one side of the moveable conductor and the yoke is positioned on the other. The spring, which is similarly not shown in the embodiments of FIGS. 5A-5G, may be located at any point along the moveable conductor such that the contacts are urged to a closed position.

In some of the forms illustrated in FIGS. 5A-5G, orientations of the parallel conductor force and the contacts are reversed. While that changes the free body diagrams discussed above, the basic concept remains the same.

Figure 5A:
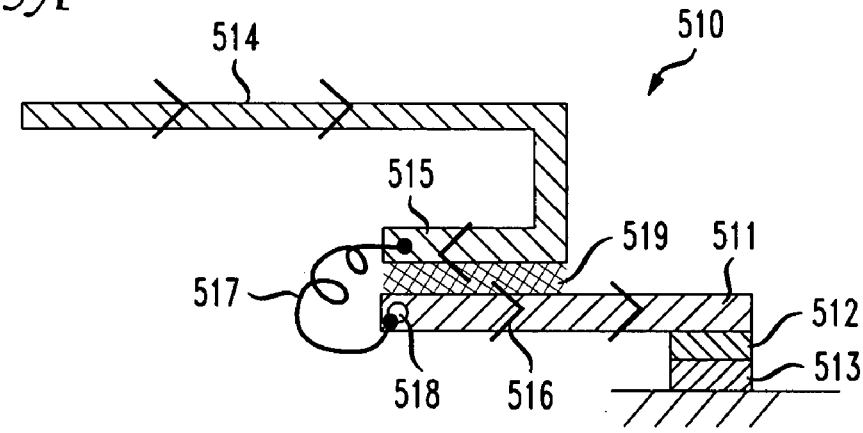
FIGS. 5A-5G are schematic diagrams showing alternative form factors of the fixed and moveable conductors in accordance with several embodiments of the invention.

FIG. 5A depicts an arrangement 510 of a moveable conductor 511 and a fixed conductor 514 as implemented for biasing a moveable contact 512 against a fixed contact 513. The moveable contact 512 is mechanically attached to the moveable conductor 511. The moveable conductor 511 has a pivot point 518 for allowing movement.

The section 515 of the fixed conductor 514 faces the section 516 of the moveable conductor 511 across a gap 519. A braided conductor 517 conducts current through the sections 515, 516 such that electromagnetic forces are created that urge the moveable contact 512 against the fixed contact 513. In the particular geometry of the arrangement 510, the flow of current through sections 515, 516 is in opposite directions, creating a repulsive force between the conductors 514, 511.

Figure 5B:
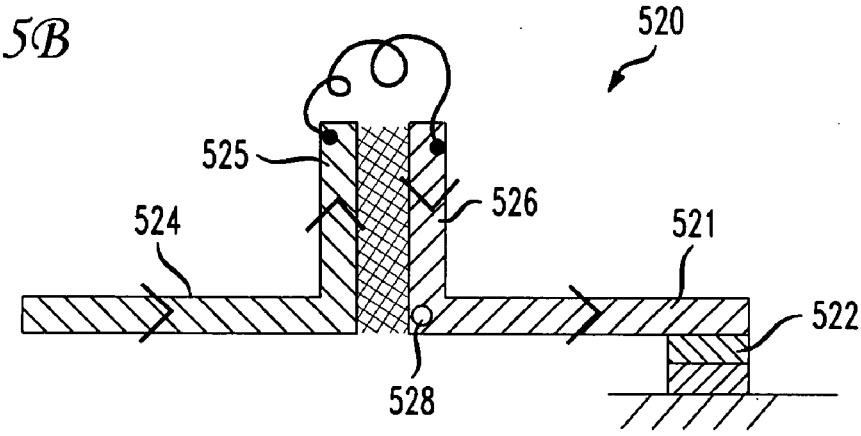

Similarly, in the arrangement 520 shown in FIG. 5B, repulsive forces are created between the section 525 of fixed conductor 524 and the section 526 of the moveable conductor 521. The force created by the parallel current paths, however, acts on a section 526 of the moveable conductor 521 on a side of the pivot 528 opposite the contact 522. That arrangement is advantageous to meet certain packaging constraints.

Figure 5C:
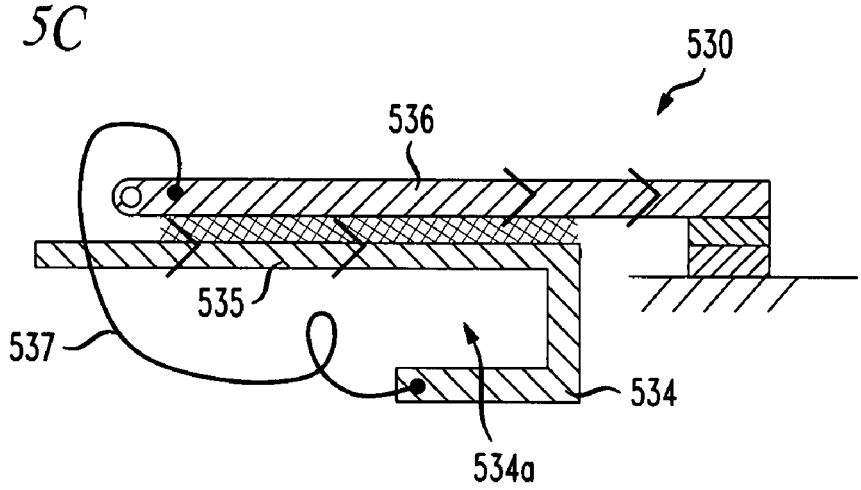

The arrangement 530 shown in FIG. 5C includes a braided conductor 537 that routes current flow through the parallel sections 535, 536 in the same direction, creating an attractive force between the two sections. Because the current flow is in the same direction, each of the sections 535, 536 contributes to the magnetic field in the electromagnetic yoke (not shown), yielding the additional advantage discussed above in combining the parallel conductor element and the electromagnet element in a single contact assembly.

The fixed conductor 534 of arrangement 530 is U-shaped, thereby defining a pocket 534*a*. That shape of the fixed conductor 534 provides an attachment point for the braided conductor 537 that reduces a parasitic magnetic field that is otherwise created by current flowing through the braided conductor. The pocket 534*a* proves a location for the magnetic yoke (not shown) that yields a compact overall package.

Figure 5D:
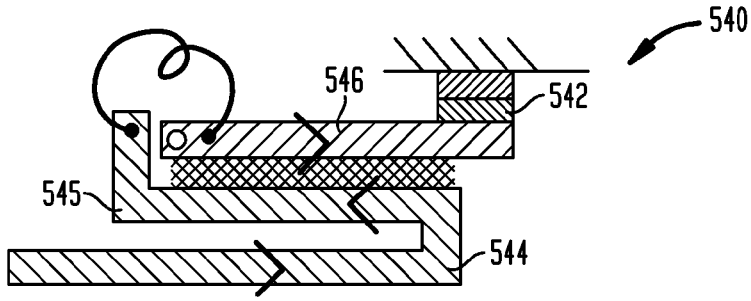
Figure 5E:
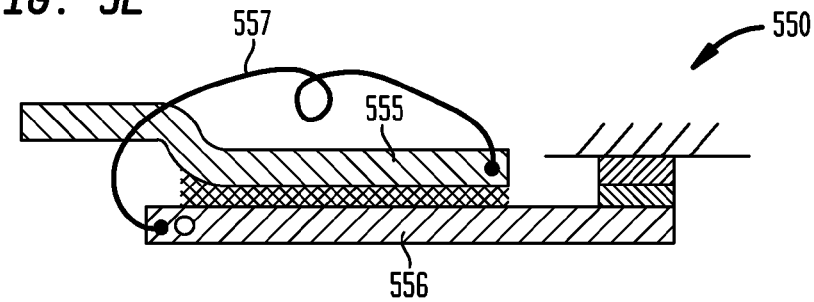
Figure 5F:
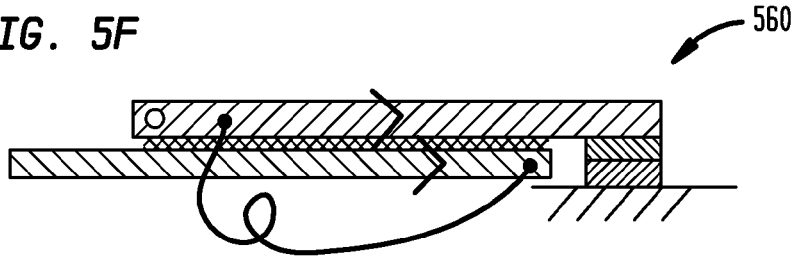
Figure 5G:
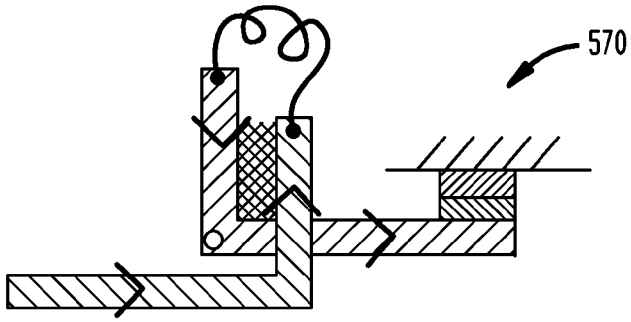

Arrangement 540 shown in FIG. 5D includes a U-shaped fixed conductor 544 and repelling sections 545, 546 to urge the moveable contact 542 to the closed position. Arrangement 550, shown in FIG. 5E, includes attracting sections 555, 556 connected by a long braided conductor 557. Arrangement 560 of FIG. 5F shows a similar arrangement. Arrangement 570 shown in FIG. 5G demonstrates a pivot arrangement similar to that of arrangement 520, but with contact position reversed.

The above arrangements illustrate how the concept of parallel conductors is used to provide an increasing contact closing force under increased current loads. When combined with an electromagnet and a spring, the arrangements produce a strong "blow closed" force. In those arrangements in which current flows in the same direction in both parallel conductors, i.e., arrangements 530, 550 and 560, current flow in the moveable conductor additionally provides an additional "turn" in the electromagnet, with the above-described advantages.

A preferred embodiment of the invention is now described with reference to FIGS. 6-9. The described embodiment was developed in consideration of the geometric constraints of a particular contact assembly. The embodiment is based on the arrangement 530 of FIG. 5C. The embodiment is particularly suitable for manufacturability and for packaging in a limited available space.

Figure 6:
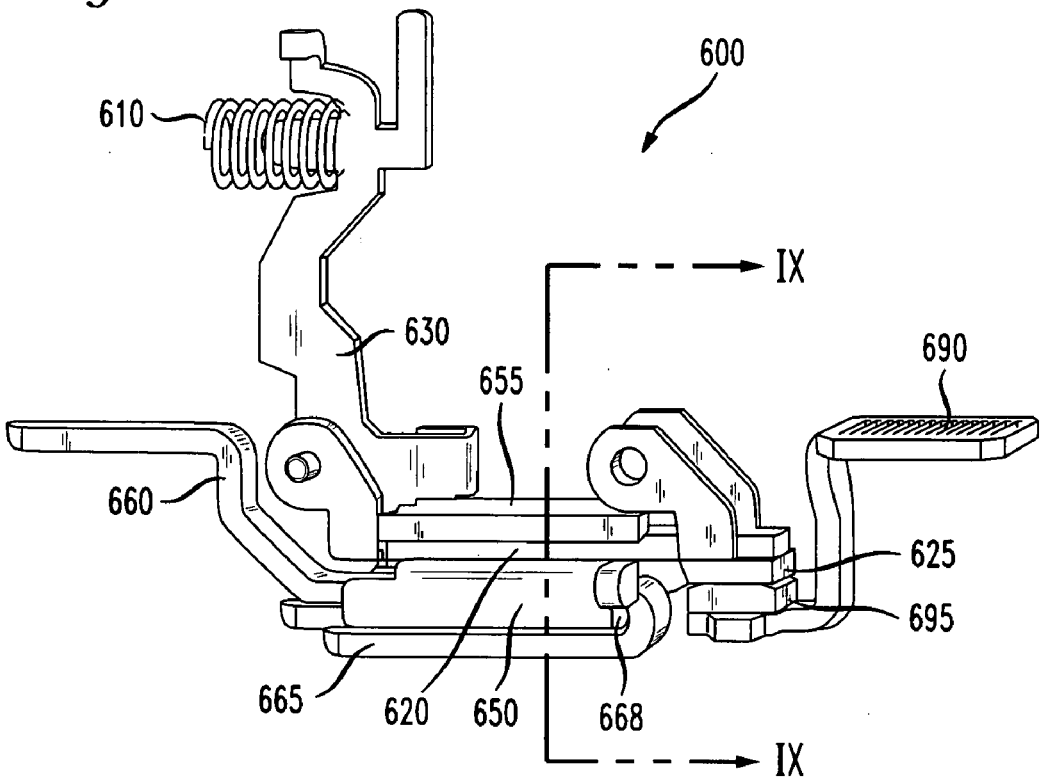
FIG. 6 is a perspective view of an electrical contact assembly in accordance with an embodiment of the invention.
Figure 7:
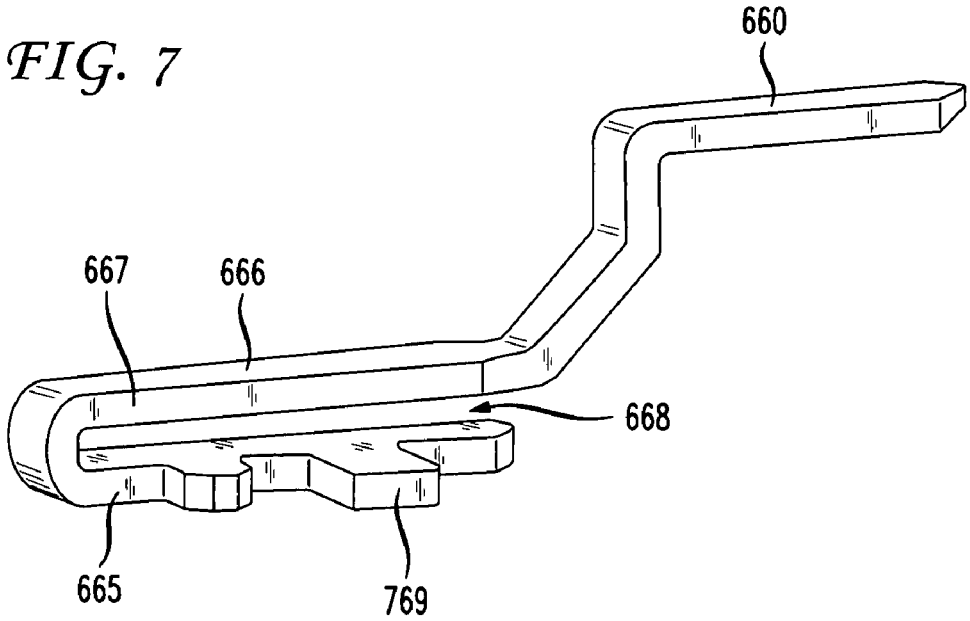
FIG. 7 is a detail view of a fixed conductor element of an electrical contact assembly in accordance with an embodiment of the invention.
Figure 8:
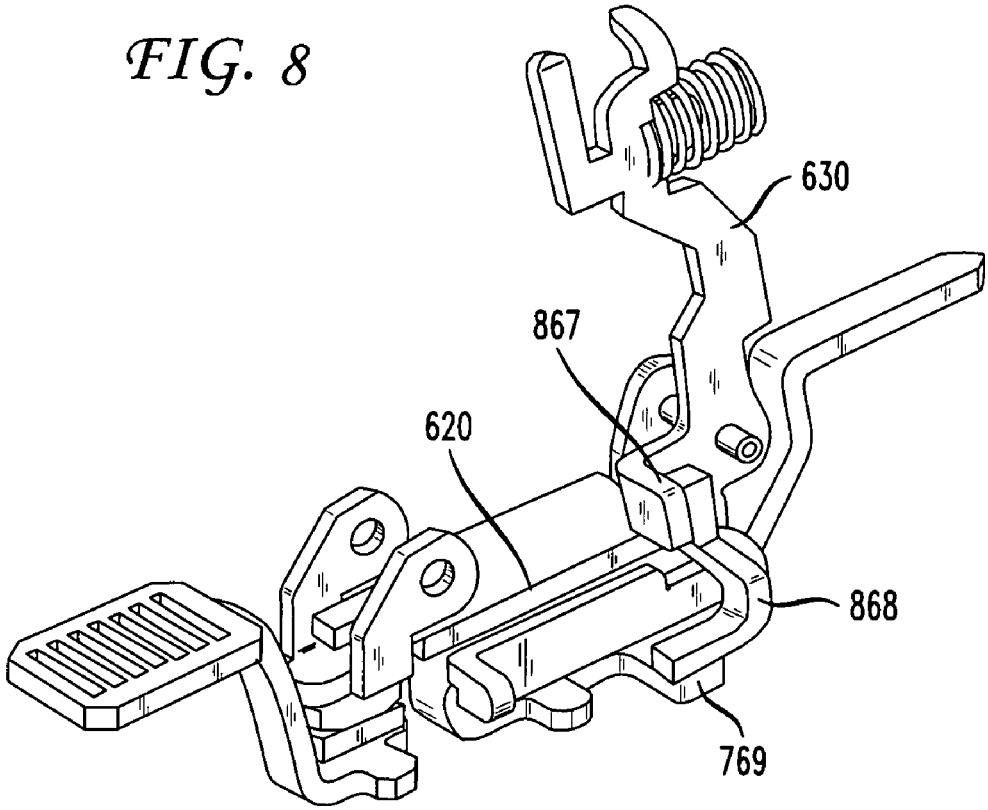
FIG. 8 is another perspective view of the electrical contact assembly shown in FIG. 6.

Referring to FIG. 6, the contact assembly 600 controls current flow between a fixed conductor 660 and a fixed contact conductor 690. Current flows through an upper leg 667 and a lower leg 665 of the U-shaped fixed conductor 660 (see also FIG. 7). The fixed conductor 660 has an off-axis tab 769 on the lower leg 665 for attaching a braided wire 868 (FIG. 8). The tab extends out of a plane of the fixed conductor 660 defined by the upper leg 667 and lower leg 665. The geometry and position of the tab 769 permits running the braid 868 perpendicular to the parallel conduction path. That geometry helps prevent parasitic loss due to a secondary field in the magnetic loop that would otherwise be caused by the braid.

As shown in FIG. 8, the braided wire 868 connects the tab 769 on the fixed conductor with a tab 867 on a moveable conductor 620. Specifically, the tab 867 is on a spring-loaded portion 630 of the moveable conductor 620.

The configuration of contact assembly 600 permits electrically connecting all conducting components using only a single braided wire. Prior designs required at least one additional braid connecting, for example, output connection tabs.

Returning to FIG. 6, current traveling through the contact assembly 600 flows through the moveable conductor 620 and through a moveable contact 625 to a fixed contact 695. The moveable contact is connected to the moveable conductor by brazing, soldering, welding or another suitable connecting technique. Similarly, the fixed contact 695 is connected to the fixed contact conductor 690, through which the current exits the contact assembly 600.

Parallel current flow takes place between the moveable contact 620 and the upper leg 667 of the fixed contact 660. A conducting surface 666 of the upper leg 667 is in close proximity to a similar conducting surface 966 of the moveable conductor 620 (see FIG. 9). Because current flows in the same direction in both conductors, the surfaces are attracted, biasing the contacts 625, 695 together.

A magnetic yoke 650 (FIG. 6) is assembled in a slot 668 (see also FIG. 7) between the upper leg 667 and lower leg 665 of the fixed conductor 660. Arms of the yoke extend upward toward the moveable conductor. Current flowing through the upper leg 667 of the fixed conductor 660 creates a magnetic field in the magnetic yoke 650. Additionally, current flowing through the moveable conductor 620 acts as a second turn of the electromagnet formed by the yoke 650, effectively doubling the magnetic force generated in the yoke by a given current through the contact assembly.

The slot 668 locates and retains the yoke 650 in position. The slot 668 therefore avoids the need for a secondary method of holding the yoke in position.

An armature 655 is placed on top of the moveable conductor 620 and mechanically secured in place by a simple brazing or welding operation. When a magnetic field is created in the yoke 650, it attracts the armature 655, thereby biasing the moveable contact 625 against the fixed contact 695. Both the armature 655 and yoke 650 are magnetic material such as iron, steel or another ferromagnetic material.

A spring 610 additionally biases the contacts 625, 695 together. In the contact assembly 600, the spring acts in a direction approximately 90 degrees from the direction of force between the contacts, and is transmitted by the spring-loaded portion 630 through a pivot to the contact 625.

Figure 9:
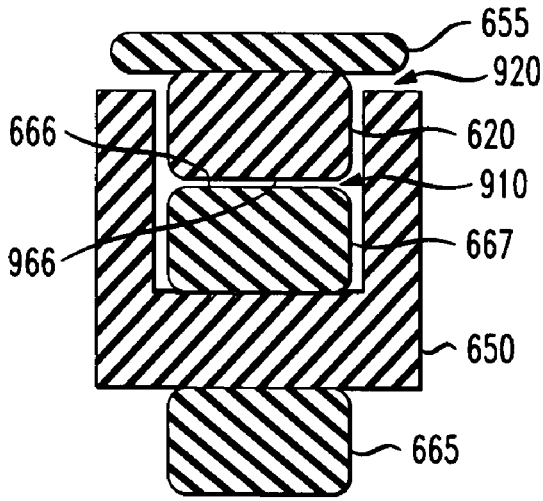
FIG. 9 is sectional view of the electrical contact assembly of FIG. 6 through the plane IX-IX.

FIG. 9 is a sectional view of the contact assembly 600 of FIG. 6 in plane IX-IX. The yoke 650 is positioned between the upper leg 667 and the lower leg 665 of the fixed conductor. The armature 655 is attached to the moveable conductor 620. Parallel current flowing through the moveable conductor 620 and the upper leg 667 create an attractive magnetic force across the gap 910. Current flowing through those two components also creates a magnetic field in the yoke 650, exerting an attractive magnetic force on the armature 655 across the gap 920. The two current paths through the leg 667 and the moveable conductor 620 effectively create a "second turn" on the yoke 650. The reverse current through the lower leg 665 on the opposite side of the yoke 650 also contributes to the magnetic field in the yoke.

The foregoing detailed description is to be understood as being in every respect illustrative and exemplary, but not restrictive, and the scope of the invention disclosed herein is not to be determined from the description of the invention, but rather from the claims as interpreted according to the full breadth permitted by the patent laws. For example, while the contact assembly is described herein with reference to particular geometric configurations, many such configurations are possible as demonstrated by the examples of FIGS. 5A-5G. It is to be understood that the embodiments shown and described herein are only illustrative of the principles of the present invention and that various modifications may be implemented by those skilled in the art without departing from the scope and spirit of the invention.

What is claimed is:

1. A contact assembly having a closed position to allow current flow through the contact assembly and an open position to prevent current flow through the contact assembly, the assembly comprising:

a moveable conductor including a moveable contact and a moveable conducting surface;

a fixed contact;

the moveable conductor being moveable between the closed position with the moveable contact contacting the fixed contact, and the open position with the moveable contact spaced apart from the fixed contact;

a fixed conductor having a fixed conducting surface proximate the moveable conducting surface when the contact assembly is in the closed position, the moveable and fixed conductors being electrically connected to conduct the current flow through the conductors in directions such that electromagnetic forces generated between the conducting surfaces resist movement of the moveable contact toward the open position;

a magnetic armature fixed to the moveable conductor;

a magnetic yoke proximate the fixed conductor, whereby current through the fixed conductor causes the yoke to exert a magnetic force on the armature, and thereby resist movement of the moveable contact toward the open position; and a braided wire electrically connecting the moveable and fixed conductors;

wherein the fixed conductor further comprises a first leg and a second leg disposed in a U-shape within a plane, and a tab extending from the fixed conductor in a direction away from the plane of the first and second legs, the braided wire being connected to the tab, whereby parasitic loss in the magnetic field of the moveable and fixed conducting surfaces due to a secondary magnetic field is reduced.

2. The contact assembly of claim 1, further comprising:

a spring biasing the moveable contact toward the fixed contact, to thereby resist movement of the moveable contact toward the open position.

3. The contact assembly of claim 1, wherein the braided wire connection is the only braided wire connection of the contact assembly.

4. The contact assembly of claim 1, wherein the U-shape formed by the first and second legs define a U-shaped portion and a slot, the yoke being positioned in the slot.

5. The contact assembly of claim 4, wherein the fixed conducting surface comprises at least a portion of the U-shaped portion.

6. The contact assembly of claim 1, wherein the electromagnetic armature is fixed to the moveable conductor by a connection selected from the group consisting of a brazed connection and a welded connection.

7. The contact assembly of claim 1, wherein the magnetic yoke is further in proximity to the moveable conductor, whereby current through the moveable conductor supplements the current through the fixed conductor in causing the yoke to exert a magnetic force on the armature, and thereby resist movement of the moveable contact toward the open position.

8. A method for maintaining a contact assembly in a closed position to allow a current flow through the contact assembly, and preventing the contact assembly from moving to an open position in which current flow is not allowed through the contact assembly, the method comprising the steps of:

displacing a moveable conductor having a moveable contact and a moveable conducting surface, from the open position with the moveable contact spaced apart from a fixed contact to the closed position with the moveable contact contacting the fixed contact;

flowing a current through the moveable conductor and through the fixed and moveable contacts;

flowing the current through a fixed conductor having a fixed conducting surface proximate the moveable conducting surface when the contact assembly is in the closed position, the fixed conductor further comprising a first leg and a second leg disposed in a U-shape within a plane, and a tab extending from the fixed conductor in a direction away from the plane of the first and second legs;

flowing the electric current through a braided wire connected to the tab and electrically connecting the moveable and fixed conductors; and flowing the current through the tab, whereby parasitic loss in the magnetic field of the moveable and fixed conducting surfaces due to a secondary magnetic field is reduced;

the flowing current through the fixed and moveable conductors generating electromagnetic forces between the fixed and moveable conductors, resisting movement of the moveable contact toward the open position; and the flowing current through the fixed and moveable conductors creating a magnetic field in a magnetic yoke in proximity to the fixed and moveable conductors, the magnetic field causing the yoke to exert a magnetic force on a magnetic armature fixed to the moveable conductor, thereby further resisting movement of the moveable contact toward the open position.

9. The method of claim 8, further comprising the step of:

biasing the moveable and fixed contacts toward each other with a spring, to thereby resist movement of the moveable contact toward the open position.

10. The method of claim 8, wherein the braided wire connection is the only braided wire connection of the contact assembly.

11. The method of claim 8, wherein the step of flowing the current through the fixed conductor comprises flowing the current around at least two opposite sides the yoke.

12. The method of claim 8, wherein the steps of generating electromagnetic forces and creating a magnetic field are performed simultaneously by current flowing through a single portion of the fixed conductor.

13. The method of claim 8, wherein the electromagnetic armature is fixed to the moveable conductor by a connection selected from the group consisting of a brazed connection and a welded connection.

14. A circuit breaker assembly positionable in a circuit between a line and a load, the assembly comprising:

a circuit breaker set to open the circuit between the line and the load at or above a predetermined current load; and a contact assembly in series with the circuit breaker and adapted to remotely open and close the circuit between the line and the load, the contact assembly having a closed position to allow current flow through the contact assembly and an open position to prevent current flow through the contact assembly, the contact assembly comprising:

a moveable conductor having a moveable contact and a moveable conducting surface;

a fixed contact;

the moveable conductor being moveable between the closed position with the moveable contact contacting the fixed contact, and the open position with the moveable contact spaced apart from the fixed contact;

a fixed conductor defining a U-shaped conducting path having a fixed conducting surface proximate the moveable conducting surface when the contact assembly is in the closed position, the U-shaped conducting path defining a slot; the moveable and fixed conductors being electrically connected to conduct the current flow through the conductors in directions such that electromagnetic forces generated thereby resist movement of the moveable contact toward the open position;

a magnetic armature fixed to the moveable conductor;

a magnetic yoke disposed in the slot defined by the U-shaped conducting path of the fixed conductor, whereby current through the fixed conductor and current through the moveable conductor both cause the yoke to exert a magnetic force on the armature, and thereby resist movement of the moveable contact toward the open position; and a braided wire electrically connecting the moveable and fixed conductors;

wherein the fixed conductor further comprises a first leg and a second leg disposed in a U-shape within a plane, and a tab extending from the fixed conductor in a direction away from the plane of the first and second legs, the braided wire being connected to the tab, whereby parasitic loss in the magnetic field of the moveable and fixed conducting surfaces due to a secondary magnetic field is reduced.

15. The circuit breaker assembly of claim 14, further comprising:

a spring biasing the moveable contact toward the fixed contact in the closed position, to thereby resist movement of the moveable contact toward the open position.

16. The circuit breaker assembly of claim 14, wherein the braided wire connection is the only braided wire connection of the contact assembly.

17. The circuit breaker assembly of claim 14, wherein the electromagnetic armature is fixed to the moveable conductor by a connection selected from the group consisting of a brazed connection and a welded connection.

18. A contact assembly having a closed position to allow current flow through the contact assembly and an open position to prevent current flow through the contact assembly, the assembly comprising:

a moveable conductor including a moveable contact;

a fixed contact;

the moveable conductor being moveable between the closed position with the moveable contact contacting the fixed contact, and the open position with the moveable contact spaced apart from the fixed contact;

a spring biasing the moveable contact toward the fixed contact, to thereby resist movement of the moveable contact toward the open position;

a fixed conductor, the moveable and fixed conductors being electrically connected in series to conduct the current through the conductors;

a magnetic armature fixed to the moveable conductor;

a magnetic yoke proximate the fixed conductor and proximate the moving conductor, whereby current through each of the fixed conductor and the moveable conductor induces a magnetic field in the yoke to attract the armature, and thereby resists movement of the moveable contact toward the open position; and a braided wire electrically connecting the moveable and fixed conductors;

wherein the fixed conductor further comprises a first leg and a second leg disposed in a U-shape within a plane, and a tab extending from the fixed conductor in a direction away from the plane of the first and second legs, the braided wire being connected to the tab, whereby parasitic loss in the magnetic field of the moveable and fixed conducting surfaces due to a secondary magnetic field is reduced.

19. The contact assembly of claim 18, further comprising:

a braided wire electrically connecting the moveable and fixed conductors.

20. The contact assembly of claim 18, wherein the U-shape formed by the first and second legs define a U-shaped portion and a slot, the yoke being positioned in the slot.

* * * * *